US006488098B1

(12) United States Patent
Davis et al.

(10) Patent No.: US 6,488,098 B1
(45) Date of Patent: Dec. 3, 2002

(54) FIRE EXTINGUISHING ACCESS PORT NOZZLE ASSEMBLY

(75) Inventors: Robert E. Davis, East Islip, NY (US); Robert Fleece, East Islip, NY (US); Douglas Nielsen, Kinnelon, NJ (US)

(73) Assignee: Logo Tech Manufacturing Inc.

( * ) Notice: Subject to any disclaimer, the term of this patent is extended or adjusted under 35 U.S.C. 154(b) by 0 days.

(21) Appl. No.: 09/597,306

(22) Filed: Jun. 20, 2000

(51) Int. Cl.[7] ..... A62C 25/00

(52) U.S. Cl. ..... 169/54; 169/51; 169/62; 169/70; 239/548; 239/554

(58) Field of Search ..... 169/16, 37, 70, 169/53, 62, 68, 51, 54; 239/548, 550, 554, 556, 566; 138/37, 42; 285/148.23, 148.18, 339, 342, 343

(56) References Cited

U.S. PATENT DOCUMENTS

| | | | | | |
|---|---|---|---|---|---|
| 389,025 | A | * | 9/1888 | Stevens | 169/70 |
| 2,466,182 | A | * | 4/1949 | Peeps | 239/550 |
| 2,535,311 | A | * | 12/1950 | McGann, Jr. | 169/70 |
| 3,713,492 | A | | 1/1973 | Forrest | |
| 4,047,572 | A | | 9/1977 | Stary et al. | |
| 4,223,740 | A | | 9/1980 | Clayton | |
| 4,697,740 | A | * | 10/1987 | Ivy | 169/70 |
| 4,700,894 | A | * | 10/1987 | Grzych | 169/70 |
| 4,711,307 | A | * | 12/1987 | Rosen | 169/54 X |
| 4,858,695 | A | | 8/1989 | Goble | |
| 4,872,513 | A | | 10/1989 | Gardner et al. | |
| 5,036,924 | A | | 8/1991 | Carino | |
| 5,154,238 | A | | 10/1992 | Buchan | |
| 5,511,622 | A | | 4/1996 | Thompson | |
| 5,516,159 | A | * | 5/1996 | Hirakawa et al. | 285/342 |
| 5,921,323 | A | | 7/1999 | Cronk | |

* cited by examiner

*Primary Examiner*—Steven J. Ganey
(74) *Attorney, Agent, or Firm*—Galgano & Burke

(57) ABSTRACT

A fire extinguishing access port includes a port and nozzle assembly where the nozzle has a plurality of radial outlets defining a pattern of dispersal for a fire extinguishing agent. According to a presently preferred embodiment, the port and nozzle assembly is dimensioned to be mounted in an existing mounting hole (e.g. a switch mounting hole) of an aircraft electrical panel with the nozzle residing in the rear of the panel and the port residing on the front of the panel. A plurality of different nozzles are provided for different electrical panels, each nozzle having a different pattern of dispersal. A fire extinguisher access port kit includes a plurality of threaded nozzles, each with different dispersal patterns, a plurality of threaded ports which mate with the nozzles, and a plurality of different length threaded tubes which mate with the nozzles and the ports. According to the presently preferred embodiment, the nozzles are provided with a plurality if radial slots which deflect the flow of fire extinguishing agent substantially perpendicular to the direction of entry through the port. This provides excellent dispersal of fire extinguishing agent throughout the electrical compartment and also provides two unexpected advantages, prevents foreign objects from passing through the port and potentially causing a short circuit, and eliminates the possibility of blowback.

22 Claims, 2 Drawing Sheets

FIRE EXTINGUISHING ACCESS PORT NOZZLE ASSEMBLY

BACKGROUND OF THE INVENTION

1. Field of the Invention

The invention relates to fire extinguishing equipment. More particularly, the invention relates to a nozzle assembly adapted to be mounted in an aircraft electrical panel so that a fire extinguishing agent can be dispersed behind the panel.

2. State of the Art

Electrical fires are a well known hazard in aviation. These fires often start behind fuse panels or switch panels. One of the chief difficulties in dealing with such fires is the difficulty in getting access to the space behind the panel.

Several prior art devices have addressed this problem by providing various kinds of "access ports" through which a fire extinguishing agent may be introduced. These access ports generally include a hole or a pipe with a flapper valve to prevent dirt from entering behind the panel .when the port is not in use. The hole or pipe is dimensioned to allow the nozzle of a hand operated fire extinguisher to fit through.

The state of the art fire access ports have several disadvantages. First, the flapper valves are less than fully effective in preventing foreign objects from entering behind the electrical panel. Second, they only provide for limited dispersion of the fire extinguishing agent. Third, they allow "blowback". Blowback occurs when fire extinguishing agent hits the back wall of an electrical panel and is deflected back out the port into the cockpit. This not only hampers the extinguishing of the fire, it is dangerous to the personnel in the cockpit.

SUMMARY OF THE INVENTION

It is therefore an object of the invention to provide a fire extinguishing access port for an aircraft electrical panel.

It is also an object of the invention to provide a fire extinguishing access port for an aircraft electrical panel which does not permit the passage of foreign objects.

It is another object of the invention to provide a fire extinguishing access port for an aircraft electrical panel which provides enhanced dispersal of fire extinguishing agent.

It is yet another object of the invention to provide a fire extinguishing access port for an aircraft electrical panel which prevents blowback.

In accord with these objects which will be discussed in detail below, the fire extinguishing access port of the present invention includes a port and nozzle assembly where the nozzle has a plurality of radial outlets defining a pattern of dispersal for a fire extinguishing agent. According to a presently preferred embodiment, the port and nozzle assembly is dimensioned to be mounted in an existing mounting hole (e.g. a switch mounting hole) of an aircraft electrical panel with the nozzle residing in the rear of the panel and the port residing on the front of the panel. According to the invention, a plurality of different nozzles are provided for different electrical panels, each nozzle having a different pattern of dispersal. A fire extinguisher access port kit according to the invention includes a plurality of threaded nozzles, each with different dispersal patterns, a plurality of threaded ports which mate with the nozzles, and a plurality of different length threaded tubes which mate with the nozzles and the ports.

According to the presently preferred embodiment, the nozzles of the invention are provided with a plurality if radial slots which deflect the flow of fire extinguishing agent substantially perpendicular to the direction of entry through the port. This provides excellent dispersal of fire extinguishing agent throughout the electrical compartment and also provides two unexpected advantages. First, it prevents foreign objects such as paper clips and the like from passing through the port and potentially causing a short circuit. Second, it eliminates the possibility of blowback.

In an exemplary embodiment, the port and nozzle are machined out of solid aluminum stock and the port is provided with a TEFLON seal. The TEFLON seal is machined from a solid rod and forms a tapered entry to the port so that the nozzle of a fire extinguisher is sealed to the port during use.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
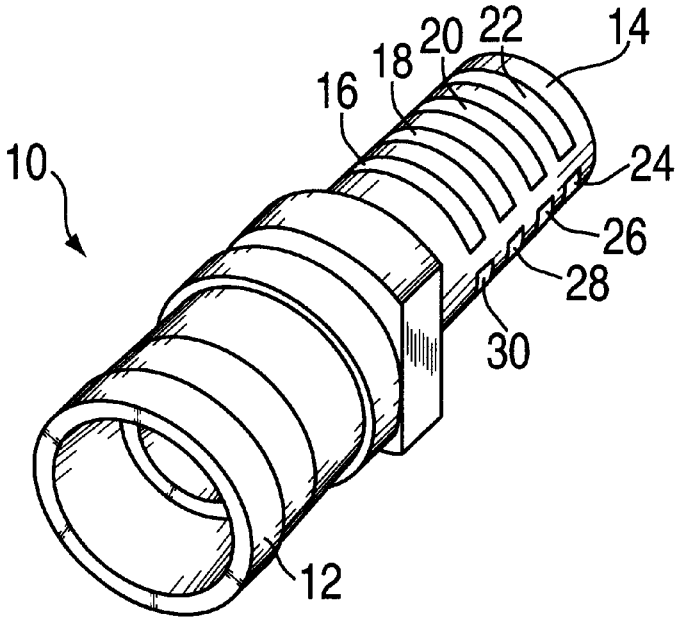
FIG. 1 is a perspective view of a first embodiment of the invention.

Referring now to FIG. 1, a fire extinguishing access port 10 according to the present invention includes a port 12 and a nozzle 14. As seen in FIG. 1, the nozzle 14 has a plurality of radial outlets 16, 18, 20, 22, 24, 26, 28, 30 defining a substantially 360° pattern of dispersal for a fire extinguishing agent.

Figure 2:
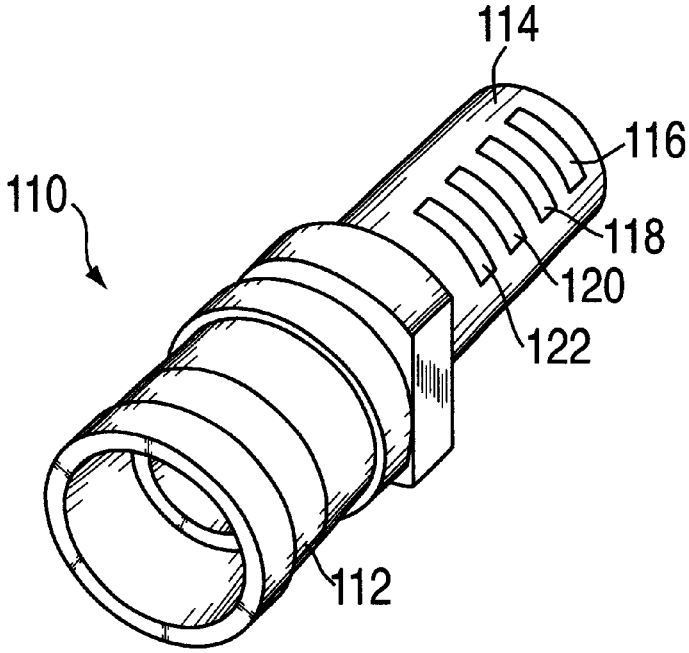
FIG. 2 is a perspective view of a second embodiment of the invention.

Turning now to FIG. 2, a second embodiment of a fire extinguishing access port 110 according to the present invention includes a port 112 and a nozzle 114. As seen in FIG. 2, the nozzle 114 has a plurality of radial outlets 116, 118, 120, 122, defining a somewhat less than 90° pattern of dispersal for a fire extinguishing agent.

According to a presently preferred embodiment, the port and nozzle assemblies 10, 110 are dimensioned to be mounted in an existing mounting hole (e.g. a switch mounting hole) of an aircraft electrical panel (not shown) with the nozzle 14, 114 residing in the rear of the panel and the port 12, 112 residing on the front of the panel. According to the invention, a plurality of different nozzles are provided for different electrical panels, each nozzle having a different pattern of dispersal.

Figure 3:
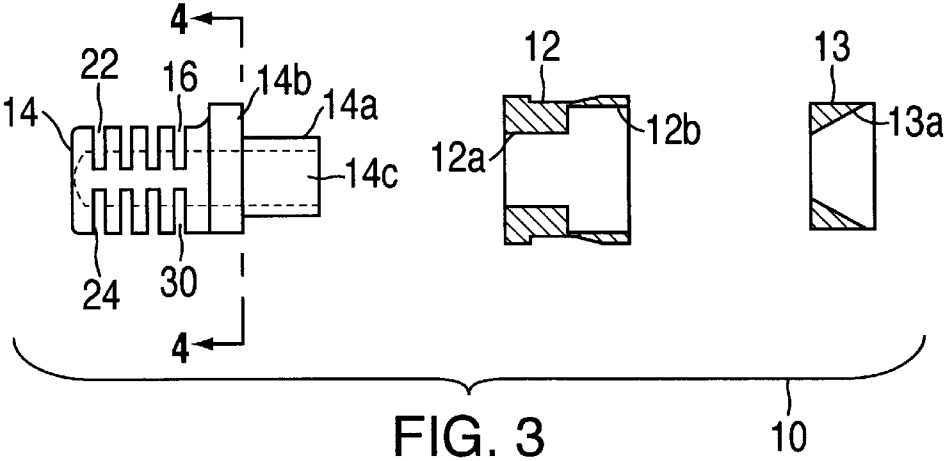
FIG. 3 is an exploded side elevational view in partial section of the first embodiment of the invention.

Referring now to FIG. 3, according to a presently preferred first embodiment, the port 12 has, a stepped throughbore 12*a*, 12*b*, and the smaller diameter portion 12*a* is threaded. The nozzle 14 has a threaded stem 14*a* which is separated from the radial outlets 16, 18, 20, 22, 24, 26, 28, 30 by a flange 14*b*. A terminating bore 14*c* passes through the stem 14*a* to the radial outlets 16, 18, 20, 22, 24, 26, 28, 30. As mentioned above, the port 12 and the nozzle 14 are threaded together through a hole in an electrical panel 50. According to the preferred embodiment, the large diameter portion 12*b* of the bore in the port 12 is provided with a TEFLON seal 13 having a tapered throughbore 13*a*.

Figure 4:
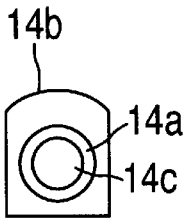
FIG. 4 is an end view of the nozzle of FIG. 3 looking in the direction 4—4 in FIG. 3.

According to an exemplary embodiment of the invention, the port 12 has an exterior diameter of approximately 0.875 inches and an axial length of approximately 0.75 inches. The inner diameter of the threaded part 12*a* is approximately 0.437 inches and it is provided with a 462-32 2A thread. The inner diameter of the large diameter part 12*b* is approximately 0.75 inches and the axial depths of parts 12*a* and 12*b* are substantially equal. Accordingly, the outer diameter of the TEFLON seal 13 is approximately 0.75 inches and the narrowest part of the tapered bore 13*a* is approximately 0.375 inches. The nozzle 14 has an overall axial length of approximately 1.5 inches, of which the stem portion 14*a* occupies approximately 0.5 inches. The overall diameter of the nozzle portion is approximately 0.525, inches with the inner bore 14*c* being approximately 0.312 inches in diameter. Each of the slots 22–30 has an axial width of approximately 0.062 inches and is spaced about 0.1 inch from its neighbor. Referring to FIG. 4, the flange 14*b* has a horizontal dimension of approximately 0.525 and a rounded top defined by a circle having a diameter of approximately 0.875 inches centered in the center of the bore 14*c*. In the exemplary embodiment, described above, the port 12 and nozzle 14 are machined out of solid aluminum stock and the TEFLON 13 seal is machined from a solid TEFLON rod.

Figure 6:
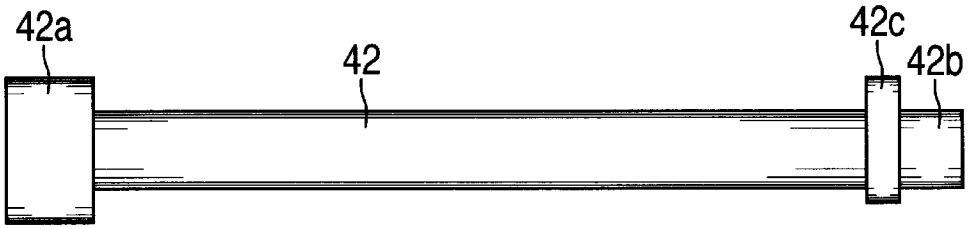
FIGS. 5–7 are side elevational views of extensions tubes for use with the nozzles and ports of the invention.
Figure 5:
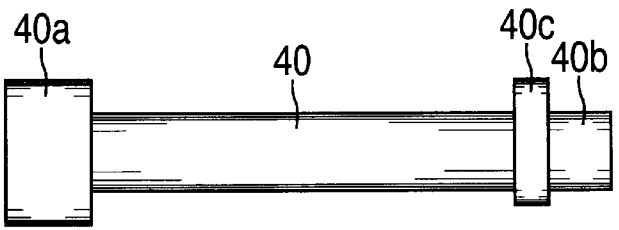
Figure 7:
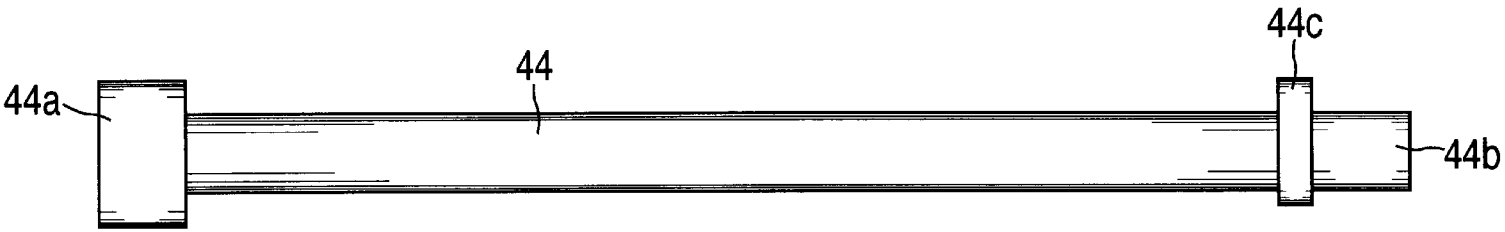

A fire extinguisher access port kit according to the invention includes a plurality of threaded nozzles 14, each with different dispersal patterns, a plurality of threaded ports 12 which mate with the nozzles 14, and a plurality of different length threaded tubes (40, 42, 44, FIGS. 5–7) which mate with the nozzles and the ports. As shown for example in FIG. 5 a tube 40 has a female threaded end 40*a*, a male threaded end 40*b*, and a flange 40*c*. The tubes 42 shown in FIG. 6 and 44 shown in FIG. 7 have the same features with similar reference numerals referring to the same features (i.e., female threadable ends 42*a*, 44*a*, male threaded ends 42*b*, 44*b*, and flanges 42*c*, and 44*c*, respectively) . The only difference among these tubes is their length. In assembling a fire extinguisher access port using the kit of the invention, one selects a tube of appropriate length and a nozzle having an appropriate dispersion pattern. The length is selected based on the depth of the compartment in which it will be installed. The dispersion pattern is selected based on the location of equipment inside the compartment.

There have been described and illustrated herein several embodiments of a fire extinguishing access port nozzle assembly. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A fire extinguishing access port and electrical panel assembly, comprising:

a) an electrical panel having two opposite sides;

b) a port member disposed generally on one side of said electrical panel; and c) a nozzle-member disposed generally on the opposite side of said electrical panel and coupled to said port member, said port member and said nozzle member defining a first fluid path, said nozzle member having a plurality of radial outlets, each of said radial outlets defining a second fluid path substantially perpendicular to said first fluid path.

2. A fire extinguishing access port and electrical panel assembly according to claim 1, wherein:

said radial outlets define a plurality of fluid paths angularly spaced apart from each other over a space of approximately 90 degrees.

3. A fire extinguishing access port and electrical panel assembly according to claim 1, wherein:

said radial outlets define a plurality of fluid paths angularly spaced apart from each other over a space of approximately 180 degrees.

4. A fire extinguishing access port and electrical panel assembly according to claim 1, wherein:

said radial outlets define a plurality of fluid paths angularly spaced apart from each other over a space of approximately 360 degrees.

5. A fire extinguishing access port and electrical panel assembly according to claim 1, further comprising:

d) a synthetic sealing member located coaxially within said port member.

6. A fire extinguishing access port and electrical panel assembly according to claim 5, wherein:

said sealing member is made of TEFLON.

7. A fire extinguishing access port and electrical panel assembly according to claim 5, wherein:

said sealing member has a tapered throughbore.

8. A fire extinguishing access port and electrical panel assembly according to claim 1, wherein:

said port member and said nozzle member are coupled to each other by threaded engagement.

9. A fire extinguishing access port and electrical panel assembly according to claim 8, wherein:

said port member has an axial length of approximately 0.75 inches and said nozzle member has an axial length of approximately 1.5 inches.

10. A fire extinguishing access port and electrical panel assembly according to claim 8, further comprising:

d) a tube member having a first end and a second end, said first end adapted to threadable engage said port member, said second end adapted to threadable engage said nozzle member.

11. A fire extinguishing access port kit and electrical panel assembly, comprising:

a) an electrical panel having two opposite sides;

b) a port member disposed generally on one side of said electrical panel;

c) a first nozzle member disposed generally on the opposite side of said electrical panel and coupled to said port member, said first nozzle member defining a first fluid path, said first nozzle member having a plurality of first radial outlets, each of said first radial outlets defining a second fluid path substantially perpendicular to said first fluid path; and d) a second nozzle member adapted to be coupled to said port member, said second nozzle member defining a third fluid path, said second nozzle member having a plurality of second radial outlets, each of said second radial outlets defining a fourth fluid path substantially perpendicular to said third fluid path, wherein the number of first radial outlets is different than the number of second radial outlets.

12. A fire extinguishing access port kit and electrical panel assembly according to claim 11, wherein:

said first radial outlets define a plurality of fluid paths angularly spaced apart from each other over a space of approximately 90 degrees.

13. A fire extinguishing access port kit and electrical panel assembly according to claim 12, wherein:

said second radial outlets define a plurality of fluid paths angularly spaced apart from each other over a space of approximately 180 degrees.

14. A fire extinguishing access port kit and electrical panel assembly according to claim 11, wherein:

said first radial outlets define a plurality of fluid paths angularly spaced apart from each other over a space of approximately 360 degrees.

15. A fire extinguishing access port kit and electrical panel assembly according to claim 11, further comprising:

e) a synthetic sealing member located coaxially within said port member.

16. A fire extinguishing access port kit and electrical panel assembly according to claim 15, wherein:

said sealing member is made of TEFLON.

17. A fire extinguishing access port kit and electrical panel assembly according to claim 15, wherein:

said sealing member has a tapered throughbore.

18. A fire extinguishing access port kit and electrical panel assembly according to claim 11, wherein:

said nozzle members are adapted to be coupled to said port member by threaded engagement.

19. A fire extinguishing access port kit and electrical panel assembly according to claim 18, wherein:

said port member has an axial length of approximately 0.75 inches and said nozzle members each have an axial length of approximately 1.5 inches.

20. A fire extinguishing access port kit and electrical panel assembly according to claim 18, further comprising:

d) a tube member having a first end and a second end, said first end adapted to threadable engage said port member, said second end adapted to threadable engage either of said nozzle members.

21. A fire extinguishing access port and aircraft electrical panel assembly, comprising:

a) an aircraft electrical panel having two opposite sides;

b) a port member disposed generally on one side of said aircraft electrical panel; and c) a nozzle member disposed generally on the opposite side of said aircraft electrical panel and coupled to said port member, said port member and said nozzle member defining a first fluid path, said nozzle member having a plurality of radial outlets, each of said radial outlets defining a second fluid path substantially perpendicular to said first fluid path.

22. A fire extinguishing access port kit and aircraft electrical panel assembly, comprising:

a) an aircraft electrical panel having two opposite sides;

b) a port member disposed generally on one side of said aircraft electrical panel;

c) a first nozzle member disposed generally on the opposite side of said aircraft electrical panel and coupled to said port member, said first nozzle member defining a first fluid path, said first nozzle member having a plurality of first radial outlets, each of said first radial outlets defining a second fluid path substantially perpendicular to said first fluid path; and d) a second nozzle member adapted to be coupled to said port member, said second nozzle member defining a third fluid path, said second nozzle member having a plurality of second radial outlets, each of said second radial outlets defining a fourth fluid path substantially perpendicular to said third fluid path, wherein the number of first radial outlets is different than the number of second radial outlets.

* * * * *